US008388213B2

(12) United States Patent
Yu

(10) Patent No.: US 8,388,213 B2
(45) **Date of Patent: *Mar. 5, 2013**

(54) SUBSTANTIALLY INSEPARABLE LED LAMP ASSEMBLY

(75) Inventor: Jing Jing Yu, El Monte, CA (US)

(73) Assignee: 1 Energy Solutions, Inc., Agoura Hills, CA (US)

( * ) Notice: Subject to any disclaimer, the term of this patent is extended or adjusted under 35 U.S.C. 154(b) by 39 days.

This patent is subject to a terminal disclaimer.

(21) Appl. No.: 13/311,774

(22) Filed: Dec. 6, 2011

(65) Prior Publication Data

US 2012/0081900 A1 Apr. 5, 2012

Related U.S. Application Data

(60) Division of application No. 11/957,294, filed on Dec. 14, 2007, now Pat. No. 8,083,393, which is a continuation-in-part of application No. 11/350,343, filed on Feb. 9, 2006, now abandoned.

(51) Int. Cl.
*H01R 33/00* (2006.01)

(52) U.S. Cl. ..... 362/645; 362/267; 362/647; 362/649; 362/373; 362/650; 445/22; 445/23; 313/309

(58) Field of Classification Search ..... 362/267, 362/645, 647, 649, 373, 650–658; 445/22, 445/23, 26, 27; 313/309–311, 495–497
See application file for complete search history.

(56) References Cited

U.S. PATENT DOCUMENTS

| | | | |
|---|---|---|---|
| 1,694,997 | A | 12/1928 | VanHorn |
| 3,425,027 | A | 1/1969 | Uberbacher |
| 3,519,913 | A | 7/1970 | Janecek |
| 3,593,038 | A | 7/1971 | Hylten-Cavallius |
| 3,639,822 | A | 2/1972 | Brown |
| 3,758,771 | A | 9/1973 | Frohardt |
| 4,035,681 | A | 7/1977 | Savage |
| 4,074,165 | A | 2/1978 | Moriyama |
| 4,223,248 | A | 9/1980 | Tong |
| 4,298,869 | A | 11/1981 | Okuno |
| 4,316,125 | A | 2/1982 | Noguchi |
| 4,321,598 | A | 3/1982 | Warner |
| 4,329,625 | A | 5/1982 | Nishizawa |
| 4,348,663 | A | 9/1982 | Yanagishima |
| 4,365,244 | A | 12/1982 | Gillessen |
| 4,367,471 | A | 1/1983 | Gillessen |
| 4,396,823 | A | 8/1983 | Nihei |
| 4,492,952 | A | 1/1985 | Miller |
| 4,521,835 | A | 6/1985 | Meggs |
| 4,528,619 | A | 7/1985 | Dolan |
| 4,595,920 | A | 6/1986 | Runyan |
| 4,652,981 | A | 3/1987 | Glynn |

(Continued)

FOREIGN PATENT DOCUMENTS

| | | |
|---|---|---|
| CA | 2342321 | 3/2000 |

OTHER PUBLICATIONS

U.S. Appl. No. 12/542,903, filed Aug. 18, 2009, by Beijing Yu.

(Continued)

*Primary Examiner* — Diane Lee
*Assistant Examiner* — Mary Zettl
(74) *Attorney, Agent, or Firm* — William W. Cochran; Cochran Freund & Young LLC

(57) ABSTRACT

Disclosed are LED lamp assemblies that are substantially inseparable. The LED lamp assemblies use discrete components that are individually manufactured and then assembled in a manner that substantially prevents disassembly or disengagement of components. An interference fit can be used to substantially secure components of the LED lamp assemblies. Bonding techniques can also be used, including adhesive and solvent bonds, as well as thermal bonds, including sonic bonds.

39 Claims, 11 Drawing Sheets

U.S. PATENT DOCUMENTS 4,675,575 A 6/1987 Smith
4,727,603 A 3/1988 Howard
4,728,849 A * 3/1988 Morris et al. ..... 313/113
4,807,098 A 2/1989 Ahroni
4,839,777 A 6/1989 Janko
4,843,280 A 6/1989 Lumbard
4,857,920 A 8/1989 Kataoka
4,954,822 A 9/1990 Borenstein
4,959,766 A 9/1990 Jain
4,967,330 A 10/1990 Bell et al.
5,087,212 A 2/1992 Hanami
5,130,897 A 7/1992 Kuzma
5,155,669 A 10/1992 Yamuro
5,187,377 A 2/1993 Katoh
5,193,895 A 3/1993 Naruke
5,239,872 A 8/1993 Meyer-Bisch
5,257,020 A 10/1993 Morse
5,313,187 A 5/1994 Choi
5,321,593 A 6/1994 Moates
5,323,305 A 6/1994 Ikeda
5,366,780 A 11/1994 Rapisarda
5,368,503 A 11/1994 Savage
5,404,282 A 4/1995 Klinke
5,410,458 A 4/1995 Bell
5,436,809 A 7/1995 Brassier
5,457,450 A 10/1995 Deese
5,463,280 A 10/1995 Johnson
5,481,444 A 1/1996 Schultz
5,499,174 A 3/1996 Lin
5,504,514 A 4/1996 Nelson
5,528,484 A 6/1996 Hayashi
5,567,037 A 10/1996 Ferber
5,580,156 A 12/1996 Suzuki et al.
5,580,159 A 12/1996 Liu
5,588,863 A 12/1996 Wu
5,634,711 A 6/1997 Kennedy et al.
5,647,759 A 7/1997 Lien
5,649,755 A 7/1997 Rapisarda
5,655,830 A 8/1997 Ruskouski
5,660,560 A 8/1997 Chong
5,663,719 A 9/1997 Deese
5,670,847 A 9/1997 Lin
5,672,000 A 9/1997 Lin
5,681,107 A 10/1997 Wang
5,688,042 A * 11/1997 Madadi et al. ..... 362/240
5,718,502 A 2/1998 Tseng
5,720,544 A 2/1998 Shu
5,722,860 A 3/1998 Pan
5,726,535 A 3/1998 Yan
5,762,419 A 6/1998 Yan
5,777,868 A 7/1998 Gibboney, Jr.
5,806,965 A 9/1998 Deese
5,808,592 A 9/1998 Mizutani
5,887,967 A 3/1999 Chang
5,890,794 A 4/1999 Abtahi
5,936,599 A 8/1999 Reymond
5,941,626 A 8/1999 Yamuro
5,962,971 A 10/1999 Chen
5,969,469 A 10/1999 Wang
5,988,831 A 11/1999 Pan
6,022,241 A 2/2000 Lin
6,048,074 A 4/2000 Wang
6,072,280 A 6/2000 Allen
6,079,848 A 6/2000 Ahroni
6,120,312 A 9/2000 Shu
6,183,104 B1 2/2001 Ferrara
6,183,310 B1 2/2001 Shu
6,190,021 B1 2/2001 Huang
6,194,839 B1 2/2001 Chang
6,200,003 B1 3/2001 Tseng
6,220,722 B1 4/2001 Begemann
6,227,679 B1 5/2001 Zhang
6,234,649 B1 5/2001 Katougi
6,283,797 B1 9/2001 Wu
6,361,192 B1 3/2002 Fussell et al.
6,361,198 B1 3/2002 Reed
6,367,952 B1 4/2002 Gibboney
6,382,812 B1 5/2002 Hsu
6,461,019 B1 10/2002 Allen
6,478,455 B2 11/2002 Ahroni
6,489,728 B2 12/2002 Guthrie et al.
6,505,954 B2 1/2003 Chen
6,550,953 B1 4/2003 Ichikawa
D474,848 S 5/2003 Lodhie
D474,849 S 5/2003 Lodhie
6,565,244 B1 5/2003 Murphy et al.
6,598,996 B1 7/2003 Lodhie
6,659,632 B2 12/2003 Chen
D485,379 S 1/2004 Steklenbug
6,709,132 B2 3/2004 Ishibashi
6,717,526 B2 4/2004 Martineau
6,739,733 B1 5/2004 Lamke et al.
6,758,578 B1 7/2004 Chou
6,796,688 B2 9/2004 Huang
6,830,358 B2 12/2004 Allen
6,869,313 B2 3/2005 Gibboney, Jr.
7,012,379 B1 3/2006 Chambers et al.
7,014,352 B2 3/2006 Wu
7,045,965 B2 5/2006 Yu
7,063,442 B2 6/2006 Sugar
7,066,628 B2 6/2006 Allen
7,066,636 B2 6/2006 Wu
7,086,756 B2 8/2006 Maxik
7,118,249 B2 10/2006 Hsu et al.
7,172,314 B2 2/2007 Currie et al.
7,217,005 B2 5/2007 Lin
7,220,022 B2 5/2007 Allen et al.
7,250,730 B1 7/2007 Allen
7,276,858 B2 10/2007 Allen
7,350,936 B2 4/2008 Ducharme et al.
7,396,142 B2 7/2008 Laizure, Jr. et al.
7,488,094 B2 * 2/2009 Murayama et al. ..... 362/336
7,501,772 B2 3/2009 Chung et al.
7,518,316 B2 4/2009 Yu
7,575,362 B1 8/2009 Hsu
7,661,852 B2 2/2010 Yu
7,784,993 B2 8/2010 Yu
7,794,124 B2 9/2010 Hulsey et al.
7,850,361 B2 12/2010 Yu
7,850,362 B2 12/2010 Yu
7,852,011 B2 12/2010 Peng
7,883,261 B2 2/2011 Yu
7,963,670 B2 6/2011 Yu
8,016,440 B2 9/2011 Yu
8,083,393 B2 12/2011 Yu
2002/0043943 A1 4/2002 Menzer et al.
2002/0097586 A1 7/2002 Horowitz
2002/0105438 A1 8/2002 Forbes
2003/0025120 A1 2/2003 Chang
2003/0079387 A1 5/2003 Derose
2003/0147245 A1 8/2003 Chen
2003/0198048 A1 10/2003 Frederick
2004/0042205 A1 3/2004 Tanabe et al.
2004/0114367 A1 6/2004 Li
2004/0135522 A1 7/2004 Berman
2004/0140892 A1 7/2004 Hanood
2004/0184270 A1 9/2004 Halter
2004/0190289 A1 9/2004 Liu
2004/0190290 A1 9/2004 Zerphy et al.
2004/0233145 A1 11/2004 Chiang
2005/0047729 A1 3/2005 Vilgiate
2005/0057187 A1 3/2005 Catalano
2005/0162851 A1 7/2005 Kazar et al.
2005/0174769 A1 8/2005 Yong et al.
2005/0213324 A1 9/2005 Chen
2006/0007679 A1 1/2006 Allen
2006/0012349 A1 1/2006 Allen
2006/0012997 A1 1/2006 Catalano
2006/0028194 A1 2/2006 Bosch
2006/0044788 A1 3/2006 Damrau
2006/0098442 A1 5/2006 Yu
2006/0180822 A1 8/2006 Yu
2006/0181884 A1 8/2006 Li
2006/0203482 A1 9/2006 Allen
2006/0256585 A1 11/2006 Pan
2006/0270250 A1 11/2006 Allen
2006/0285325 A1 12/2006 Ducharme et al.

| | | | | |
|---|---|---|---|---|
| 2006/0291256 | A1 | 12/2006 | Cobbler | |
| 2007/0025109 | A1 | 2/2007 | Yu | |
| 2007/0064450 | A1 | 3/2007 | Chiba et al. | |
| 2007/0183153 | A1 | 8/2007 | Yu | |
| 2007/0241357 | A1* | 10/2007 | Yan | 257/98 |
| 2008/0024071 | A1 | 1/2008 | Yu | |
| 2008/0025024 | A1 | 1/2008 | Yu | |
| 2008/0094857 | A1 | 4/2008 | Smith et al. | |
| 2008/0143234 | A1 | 6/2008 | Yu | |
| 2008/0157686 | A1 | 7/2008 | Chung et al. | |
| 2008/0186704 | A1 | 8/2008 | Chou et al. | |
| 2008/0258649 | A1 | 10/2008 | Yu | |
| 2008/0285279 | A1 | 11/2008 | Ng et al. | |
| 2009/0027903 | A1* | 1/2009 | Yu | 362/378 |
| 2009/0059565 | A1 | 3/2009 | Bertram | |
| 2009/0116236 | A1 | 5/2009 | Chiang | |
| 2009/0213602 | A1 | 8/2009 | Gallegos | |
| 2010/0067222 | A1* | 3/2010 | Yu | 362/158 |
| 2010/0073963 | A1 | 3/2010 | Yu | |
| 2010/0109560 | A1 | 5/2010 | Yu | |
| 2010/0264806 | A1 | 10/2010 | Yu | |

OTHER PUBLICATIONS

Chinese Patent Application No. 200920172743.1 filed Apr. 20, 2009 by Jing Jing Yu.
U.S. Appl. No. 09/339,616; Inventor: Tuyet Thi Vo; abandoned.
U.S. Appl. No. 09/378,631, Inventor: Tuyet Thi Vo; abandoned.
U.S. Appl. No. 11/716,788, filed Mar. 12, 2007, by Jing Jing Yu.
U.S. Appl. No. 12/098,423, filed Apr. 5, 2008, by Jing Jing Yu.
U.S. Appl. No. 61/043,262, filed Apr. 8, 2008, by Jing Jing Yu.
U.S. Appl. No. 60/949,804, filed Jul. 13, 2007, by Jing Jing Yu.
Non-Final Office Action mailed Sep. 7, 2010, in U.S. Appl. No. 11/957,294, filed Dec. 14, 2007, by Jing Jing Yu.
U.S. Appl. No. 12/431,098, filed Apr. 28, 2009, by Jing Jing Yu.
U.S. Appl. No. 12/610,117, filed Oct. 30, 2009, by Jing Jing Yu.
U.S. Appl. No. 11/350,343, filed Feb. 9, 2006, by Jing Jing Yu.
Final Office Action mailed Mar. 24, 2011, in U.S. Appl. No. 11/957,294, filed Dec. 14, 2007, by Jing Jing Yu.

* cited by examiner

SUBSTANTIALLY INSEPARABLE LED LAMP ASSEMBLY

CROSS-REFERENCE TO RELATED APPLICATIONS

This application is a divisional application of U.S. patent application Ser. No. 11/957,294, entitled "Substantially Inseparable LED Lamp Assembly," filed Dec. 14, 2007, by Jing Jing Yu, which application is a continuation-in-part of U.S. patent application Ser. No. 11/350,343, entitled "A New All-in-One LED Assembly, String Assembly and Method," filed Feb. 9, 2006, by Jing Jing Yu. The entire contents of the above mentioned applications are hereby specifically incorporated herein by reference for all that they disclose and teach.

BACKGROUND OF THE INVENTION

Semiconductor light emitting diodes (LEDs) have been widely used for decorative lighting, especially on holidays. LED light strings are inexpensive, have superior physical properties, including low operating voltage and power, small size, long lifetime, and a high degree of stability. Further, LEDs do not operate at high temperatures and do not generate the heat of normal incandescent bulbs, and as such, provide a safer source of decorative lighting.

SUMMARY OF THE INVENTION

An embodiment of the present invention may therefore comprise a method of assembling a substantially inseparable LED lamp assembly from individual discrete components comprising: providing a lamp holder that is formed as an annulus with a first opening on a first end of the annulus and a second opening on a second end of the annulus; substantially permanently securing a lamp cover to the first end of the annulus so that the lamp cover is substantially inseparable from the lamp holder and forms a watertight seal with the lamp holder; providing an LED lamp having LED pin leads; attaching wires directly to the LED pin leads of the LED lamp that have a predetermined size and a predetermined shape; inserting the LED lamp through the second opening of the second end of the annulus to a position where the LED lamp is oriented to allow light from the LED lamp to be transmitted through the lamp cover; substantially permanently attaching the LED lamp directly to the annulus so that the LED lamp is substantially inseparable from the annulus; inserting a plug into the second opening of the second end of the annulus, the plug having indentations along an outer surface that substantially match the predetermined size and the predetermined shape of the wires so that the plug forms a watertight seal with the wires; substantially permanently sealing the plug in the second opening to form a watertight seal at the second end of the annulus.

An embodiment of the present invention may further comprise an LED lamp assembly that is constructed of individual components that are separately fabricated and are assembled to provide a substantially inseparable LED lamp assembly comprising: a lamp holder that is shaped as an annulus, the annulus having a first opening on a first end and a second opening on a second end; a lamp cover substantially permanently attached to the first end of the annulus so that the lamp cover is substantially inseparable from the lamp holder and a watertight seal is formed between the lamp cover and the lamp holder; an LED lamp inserted through the second opening of the annulus and substantially permanently attached in the annulus so that the LED lamp is substantially inseparable from the lamp holder and forms a watertight seal with the lamp holder in a position that orients the LED lamp to allow light to be transmitted through the lamp holder, the LED lamp having LED lead pins attached to the LED lamp; wires that are conductively connected directly to the LED lead pins and extend through the second opening of the second end of the annulus, the wires having a predetermined size and shape; a plug having indentations along an outer surface that substantially match the predetermined size and shape of the wires, the plug substantially permanently inserted in the second opening to prevent disassembly of the LED lamp assembly and to create a watertight seal between the plug and the second opening in the annulus.

DETAILED DESCRIPTION OF EMBODIMENTS OF THE INVENTION

Figure 1:
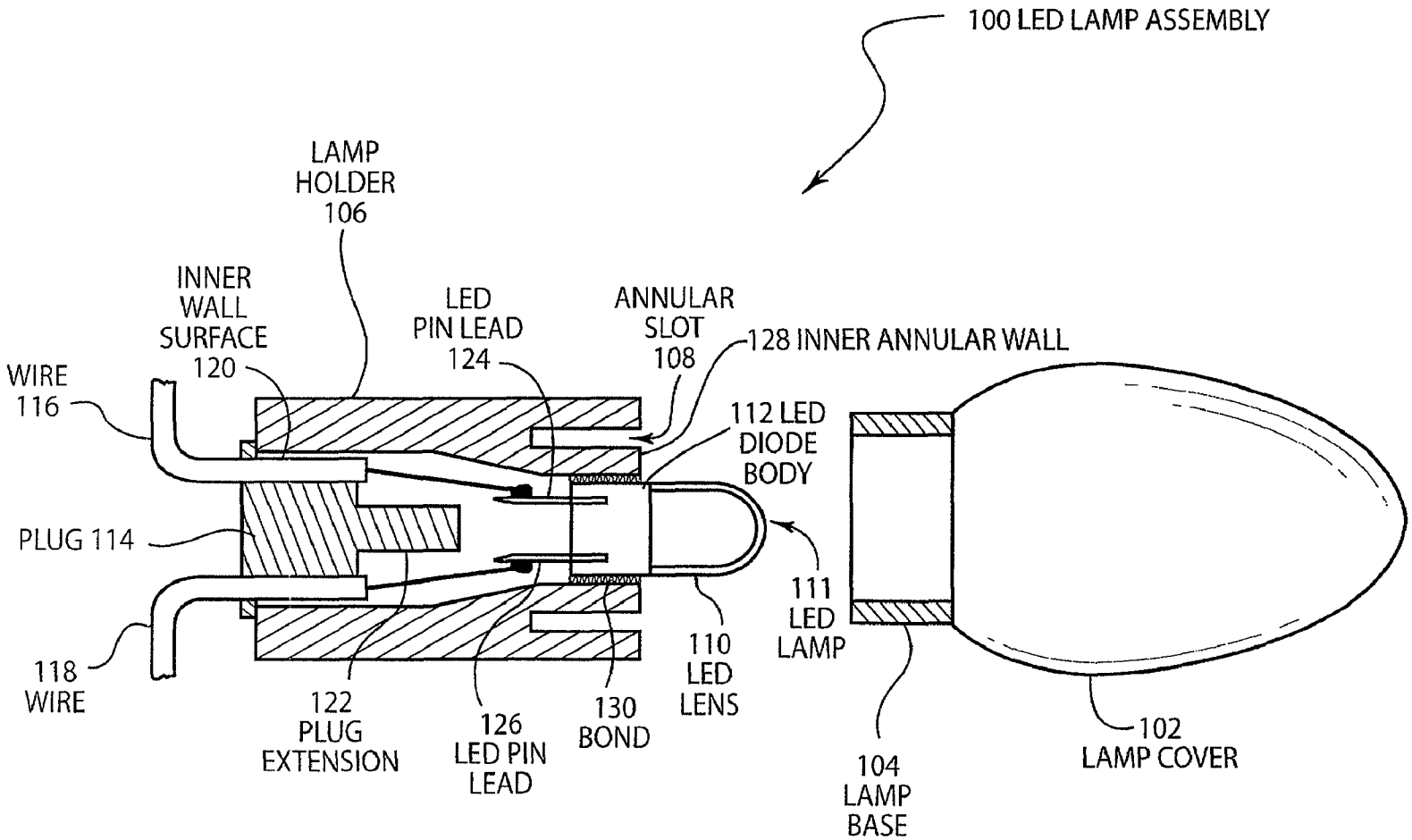
FIG. 1 is a schematic illustration of an embodiment of an LED lamp assembly.

FIG. 1 is a schematic illustration of an embodiment of an LED lamp assembly 100. Generally, there are two types of LED light strings, i.e. light strings that have separable lamps and light strings that have inseparable lamps. Separable lamps allow a user to disassemble the lamp and replace the LED or other parts that are not functioning. In addition, separable LED lamps have the advantage of allowing the manufacturer to separately manufacture the pieces for later assembly. Manufacturing of discrete components allows for flexibility in production and assembly. The disadvantage of having LED strings with separable lamps is that portions of the lamp assembly can become disassembled during shipping or installation, so that the LED string becomes either partially or wholly inoperable. Further, separable LED lamps are subject to theft and vandalism. This problem is compounded in series wired LED strings, in which the entire string fails to light if a single LED becomes disconnected. For example, if a removable LED string becomes accidentally disconnected during shipping or installation, the entire string will fail to light.

Inseparable LED strings avoid many of the problems associated with LED strings made from separable LED lamps. Inseparable LED lamps are not subject to accidental disconnection, theft or vandalism, for the most part, because the LEDs are hardwired into the LED string and overmolded in injection molding machines. In other words, the LED lamps are soldered directly to the wires of the lighting string and are then overmolded in an injection molding machine. The disadvantage of this process is that it is expensive to individually overmold each LED lamp using injection molding devices and to perform the final assembly of the components at the injection molding machine site. Further, the high temperatures used in the injection molding process often damage the LED lamps, resulting in low yield. If a single LED lamp is damaged in a series wired LED light string during the injection molding process, the entire light string will be inoperable.

Various embodiments are disclosed herein that provide a substantially inseparable lamp that is fabricated from discrete parts that can be separately manufactured and later assembled in a substantially inseparable lamp assembly that overcomes many of the disadvantages of both separable and inseparable LED lamp assemblies. As used herein, the terms "substantially inseparable" means that the LED lamp assembly is not separable by hand using forces that can be manually generated, or without the use of special tools. Of course, everything is separable if sufficient force is applied. However, damage may result to the lamp assembly from the application of forces that exceed normal manual forces that can be generated by hand.

Referring again to FIG. 1, the LED lamp assembly 100 includes a lamp cover 102, having a lamp base 104 that is adapted to fit in an annular slot 108 of the lamp holder 106. The lamp base 104 may have a size and shape such that there is an interference fit between the lamp base 104 and the annular slot 108. The interference fit allows the lamp base 104 to be inserted in the annular slot 108 in a manner that substantially prevents removal of the lamp cover 102. When the lamp base 104 is inserted into the annular slot 108, forces are created on the material of the inner wall of the annular slot 108 that create a force against the LED diode body 112. The force of the inner annular wall 128 on the LED diode body 112 may create an interference fit or assist in securing a bond 130 that may be formed between the LED body 112 and the inner wall surface 120. The bond between the lamp base 104 and the annular slot 108 can be formed using an adhesive, a solvent, or thermal welding, including sonic welding.

As also illustrated in FIG. 1, the LED lamp assembly 100 includes an LED lamp 111 that is secured to a first opening in the lamp holder 106. The lamp holder 106 may be formed as an annulus, having various shapes. Lamp base 104 may be a round annulus or other shape that matches the lamp holder 106. LED lamp 111 has an LED diode body 112 that is secured to the inner wall 120 of the annulus of the lamp holder 106. The LED diode body 112 may be secured to the inner wall 120 by an interference fit or by bonding the LED diode body 112 to the inner wall 120. Various bonding techniques can be used, including adhesive bonding, thermal bonding, including sonic bonding, or other various techniques, including the use of solvents. The LED diode body 112 is secured to the inner wall 120 so that the LED lens 110 protrudes from the first opening of the lamp holder 106 and emits light in the lamp cover 102 when the lamp cover 102 is substantially inseparably attached to the lamp holder 106.

The LED lamp assembly 100 of FIG. 1 also includes a plug 114. Plug 114 is inserted into the second opening of the lamp holder 106 and creates an interference fit with the inner wall 120 of the second opening of the lamp holder 106. Wires 116, 118 are disposed in grooves (disclosed below in FIGS. 2-4) that have an arcuate shape and that allow the plug 114 to fit tightly within the second opening of the lamp holder 106 and provide a substantially water resistant or watertight fit that prevents water and other contaminants from entering the interior portion of the annulus of the lamp holder 106. The plug 114 can be made of a malleable elastic-type material that allows deformation of plug 114 to create an interference fit and substantially seal the second opening of the lamp holder 106. Alternatively, the material of the lamp holder 106 can be made of a malleable material, so that the inner wall 120 of the lamp holder 106 creates a seal around a plug 114 made of a harder material. Alternatively, plug 114 can be bonded to the inner wall 120 using an adhesive bond, a thermal bond, including a sonic bond, or a bond created by a solvent. Wires 116, 118 are attached to LED pin leads 124, 126, respectively, to complete the electrical circuit with the LED lamp 111. Plug 114 may also include a plug extension 122 that is made from an insulating material that assists in preventing wires 116, 118 from touching and causing a short circuit. Alternatively, wires 116, 118 can be fed through round openings (not shown) in the body of plug 114. Such openings would allow the wires 116, 118 to be fed through the plug 114 and provide a seal between the wires 116, 118 and the openings to prevent moisture or other contaminants from entering the lamp holder 106. The process of feeding the wires 116, 118 through the plug 114 would necessarily occur prior to attachment of the wires 116, 118 to LED pins 124, 126.

The advantage of the LED lamp assembly 100 illustrated in FIG. 1 is that each of the elements can be manufactured separately and then later assembled into the LED lamp assembly 100, which is substantially inseparable. In other words, the LED lamp assembly cannot be disassembled without either damaging the LED lamp assembly, or using excessive force or specialized tools.

Figure 2:
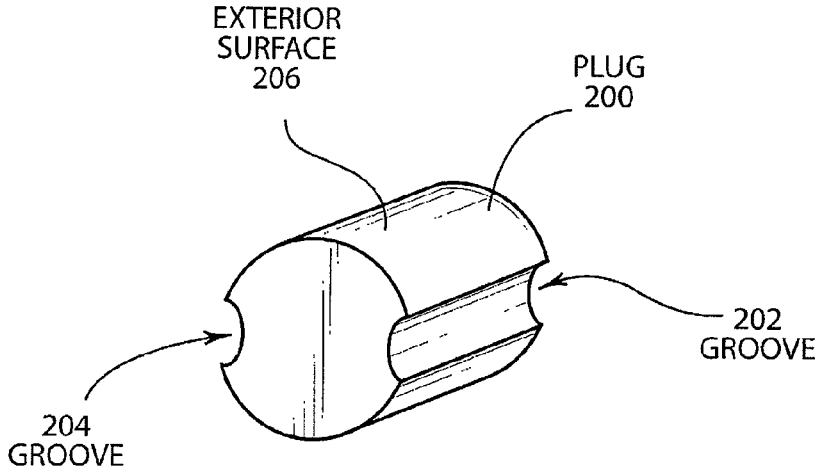
FIG. 2 is a schematic illustration of a plug.

FIG. 2 is a schematic isometric drawing of a plug 200. Plug 200 may be similar to plug 114 illustrated in FIG. 1. Grooves 202, 204, that have an arcuate shape, are formed in the exterior surface 206 of the plug 200 to allow space for the wires, such as wires 116, 118, to be inserted into the second opening of the lamp holder 106. The plug 200 biases the insulation of the wires 116, 118 towards the inner wall surface 120 of the lamp holder 106 and substantially surrounds and seals the wires 116, 118.

Figure 3:
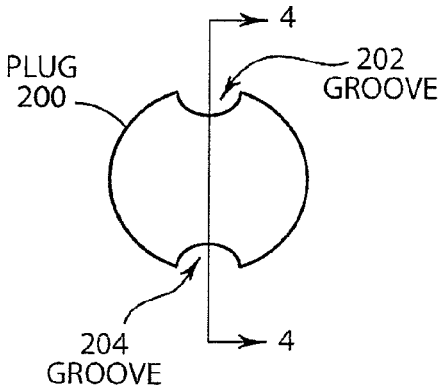
FIG. 3 is an end view of the plug of FIG. 2.

FIG. 3 is an end view of the plug 200 illustrated in FIG. 2. As shown in FIG. 3, plug 200 includes grooves 202, 204 that have an arcuate shape and are indented sufficiently to allow the wires, such as wires 116, 118, to be biased to the inner wall of the lamp holder and sealed in the second opening of the lamp holder 106. Generally, the material of the plug 200 is sufficiently malleable and elastic to surround the wire sufficiently to substantially create a seal with the lamp holder 106. Fillers and adhesive fillers may be used to ensure that a watertight seal is created using plug 200.

Figure 4:
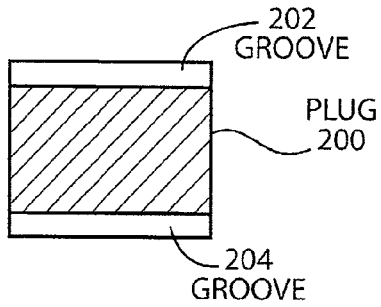
FIG. 4 is a cross-sectional view of the plug of FIG. 3.

FIG. 4 is a cross-sectional view of FIG. 3. As shown in FIG. 4, plug 200 includes the grooves 202, 204.

Figure 5:
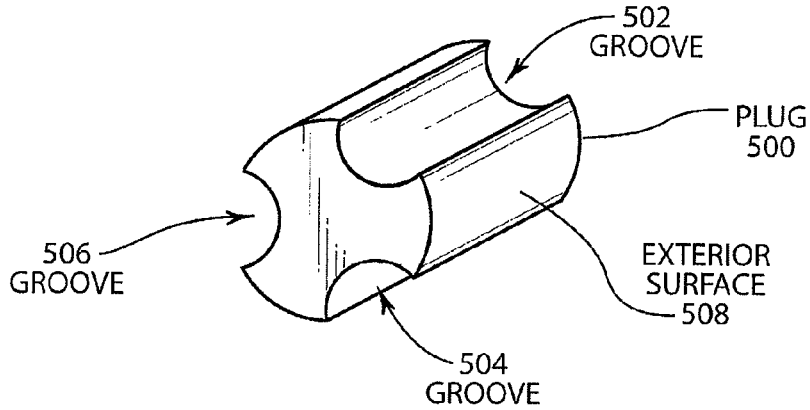
FIG. 5 is a schematic illustration of another embodiment of a plug.

FIG. 5 is an isometric view of another embodiment of a plug 500. Plug 500 has three grooves 502, 504, 506 that are formed in the exterior surface 508 of the plug 500. Three wires may be required to wire LED lamps in a parallel configuration in a lighting string, which necessitates the use of three grooves in plug 500.

Figure 6:
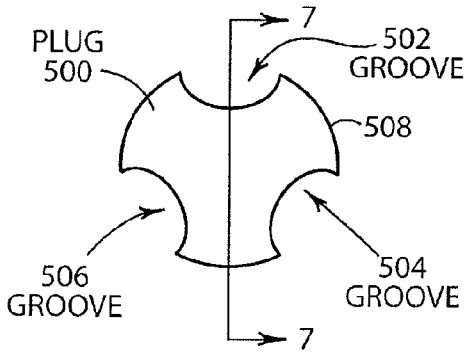
FIG. 6 is an end view of the plug illustrated in FIG. 5.

FIG. 6 is an end view of plug 500 of FIG. 5. Grooves 502, 504, 506 are formed in the exterior surface 508 to allow three wires to be inserted in the second opening of the annulus of the lamp holder. Grooves 502, 504, 506 have a shape and size that allows the wires to fit around the plug in the second opening of the lamp holder. Again, plug 500 is sufficiently malleable to create a substantially watertight seal in the second opening of the lamp holder.

Figure 7:
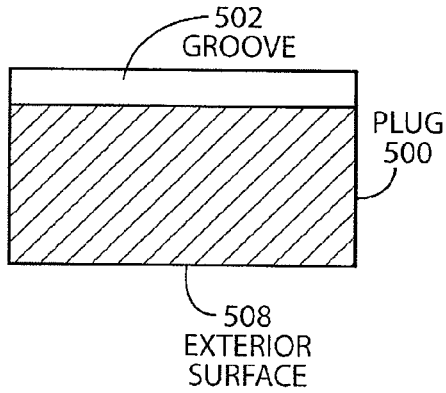
FIG. 7 is a cross-sectional view of the plug of FIG. 6.

FIG. 7 is a cross-sectional view of FIG. 6. As shown in FIG. 7, plug 500 includes a groove 502 in the exterior surface 508 of plug 500.

Figure 8:
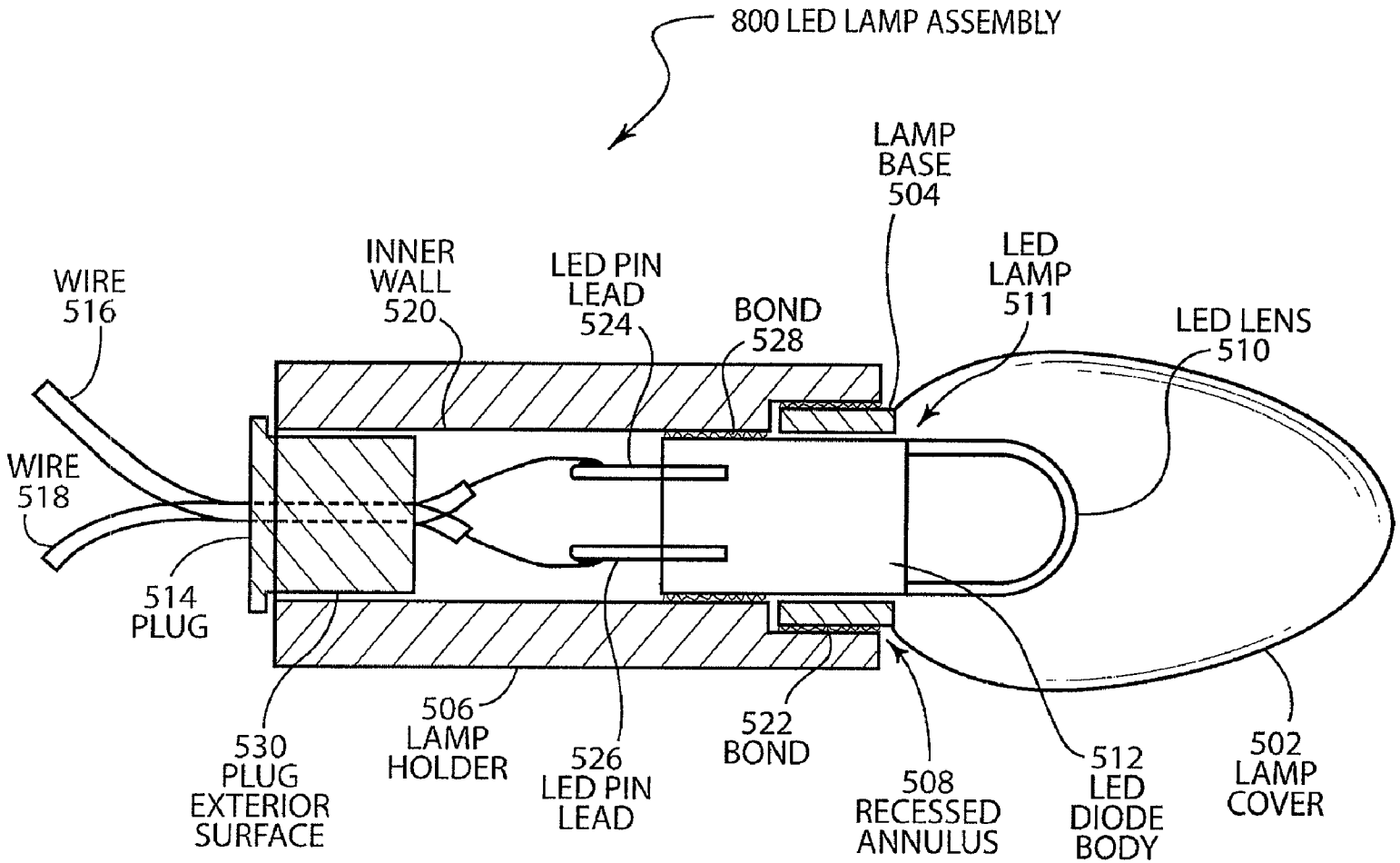
FIG. 8 is a schematic illustration of another embodiment of an LED lamp assembly.

FIG. 8 is a schematic illustration of another embodiment of an LED lamp assembly 800. As shown in FIG. 8, lamp cover 502 has a lamp base 504 that is inserted in a recessed annulus 508 of the lamp holder 506. The recessed annulus may create an interference fit between the lamp base 504 and the recessed annulus 508, or a bond 522 may be created between the recessed annulus 508 and the lamp base 504. The LED lamp 511 has an LED diode body 512 that is attached to the inner wall 520 of the lamp holder 506. The LED diode body 512 can be attached to the inner wall 520 by an interference fit or by a bond 528, including an adhesive bond, a solvent bond, or a thermal bond, including a sonic bond. The diode body 512 is attached so that the LED lens 510 is disposed within the lamp cover 502 to emit light from the lamp cover 502. The LED lamp 511 has LED pin leads 524, 526 that are connected to wires 516, 518, respectively. Plug 514 may be similar to plug 200 of FIG. 2, or plug 500 of FIG. 5, which have grooves along the outer surface that allow the plug 514 to be inserted after wires 516, 518 are connected to the LED pin leads 524, 526. Plug 514 may be made of a malleable, elastic-type of material that easily deforms and can be made larger than the second opening in the lamp holder 506, so that a seal is created between the plug exterior surface 530 and the inner wall 520, as a result of an interference fit between the plug 514 and the second opening in the lamp holder 506. Alternatively, plug 514 can be bonded to the lamp holder 506 using adhesives, adhesive fillers, thermal bonds, including sonic bonds, or solvent bonds. Once the LED lamp assembly 800 is fully assembled, it is substantially inseparable.

Figure 9:
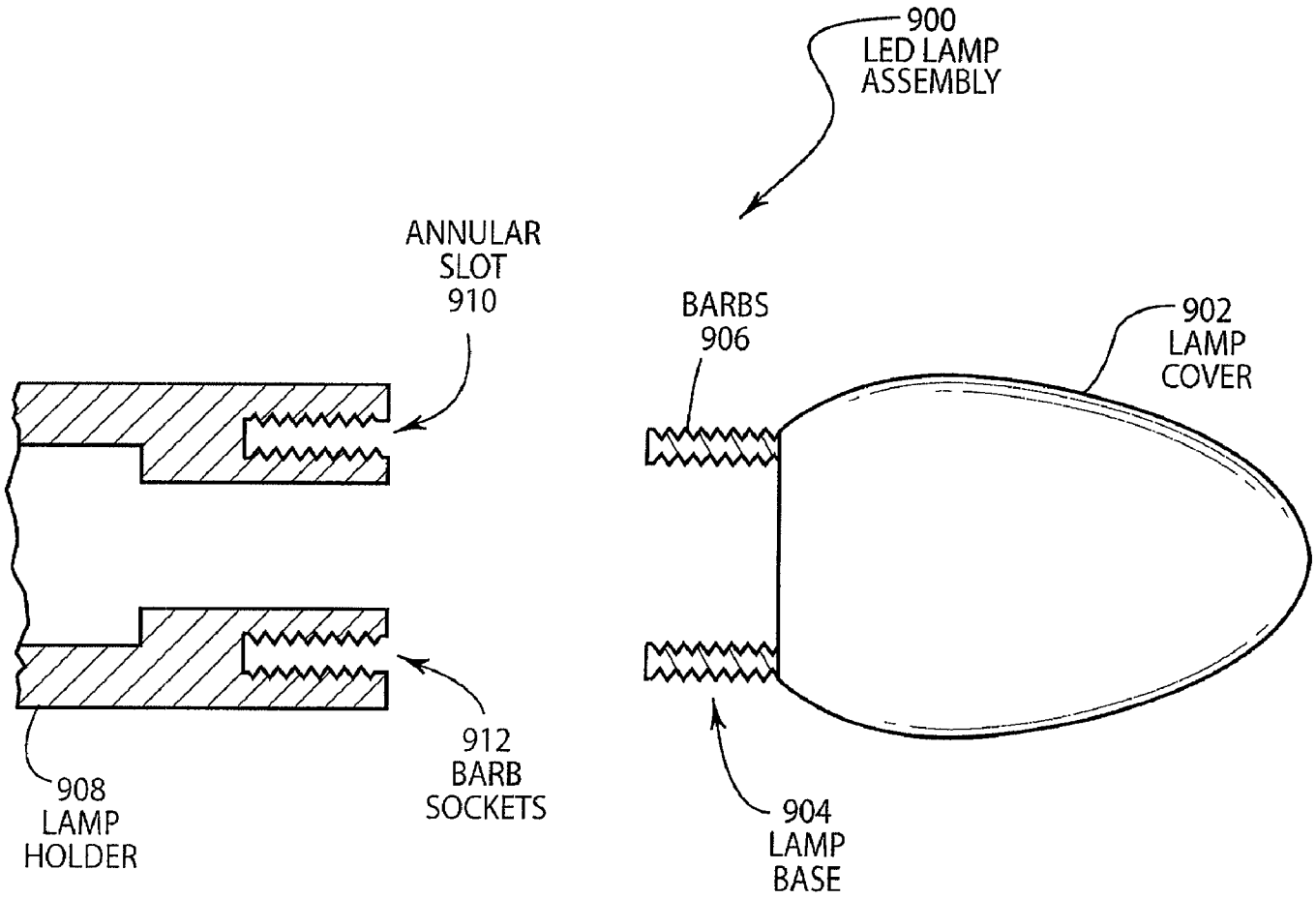
FIG. 9 is a schematic illustration of another embodiment of an LED lamp assembly.

FIG. 9 is a schematic illustration of another embodiment of an LED lamp assembly 900. The LED lamp assembly 900 illustrated in FIG. 9 shows the use of barbs 906 disposed on the lamp base 904 of the lamp cover 902 that interface with barb sockets 912 that are disposed in the annular slot 910 of lamp holder 908. When the lamp base 904 is inserted into the annular clot 910, the barbs 906 engage with the harp sockets 912 to prevent removal of the lamp cover 902 from the lamp holder 908. The barbs 906 and barb sockets 912 can be disposed on either the lamp base 904 or the annular slot 910, as desired. The barbs 906 and barb sockets 912, or other types of interference mechanisms, can be used in any of the embodiments to enhance an interference fit, including interference fits between the lamp base and the lamp holder, the LED diode body and the interior wall surface of the lamp holder, or the plug to the interior surface of the lamp holder, as desired. The use of barbs 906 and barb sockets 912 increase the effectiveness of an interference fit, as described herein, but are not required to create an interference fit. Further, the interference fit that either uses or fails to use barbs and barb sockets can be further aided in forming a substantially inseparable connection through the additional use of a bond.

Figure 10:
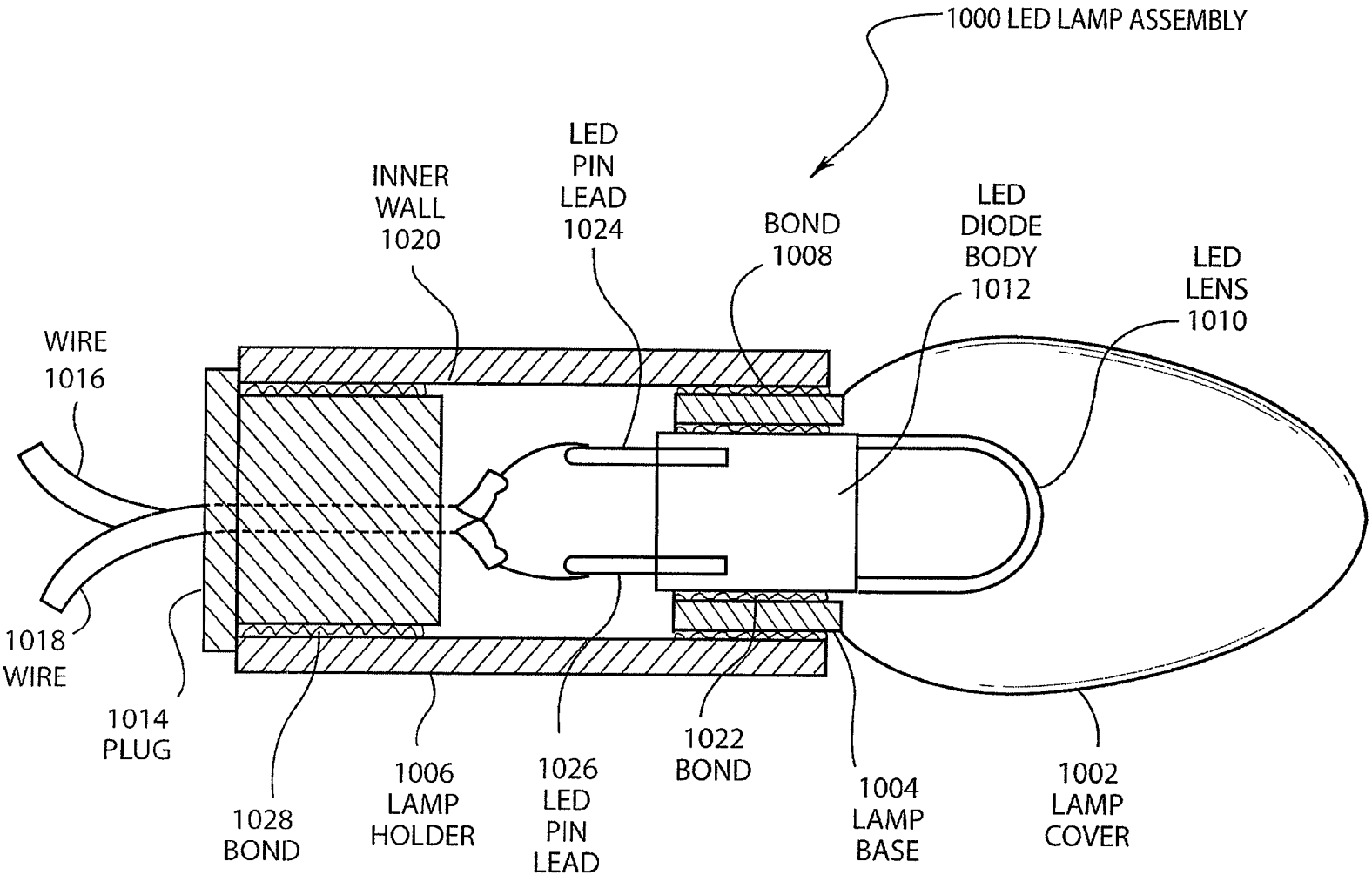
FIG. 10 is a schematic illustration of another embodiment of an LED lamp assembly.

FIG. 10 is a schematic illustration of another embodiment of an LED lamp assembly 1000. As shown in FIG. 10, lamp cover 1002 has a lamp base 1004 that is inserted in a first opening of lamp holder 1006. The lamp base 1004 may have an interference fit with the inner wall 1020 of the lamp holder 1006, which holds the lamp base 1004 and the lamp cover 1002 securely within the lamp holder 1006. The interference fit can constitute a simple friction fit, or may employ other interference mechanisms, including the barbs and barb sockets illustrated in FIG. 9. Alternatively, bond 1008 can be used to secure the lamp base 1004 to the interior wall 1020 of the lamp holder 1006. Bond 1008 can be an adhesive bond, a thermal bond, including a sonic bond, or a bond formed by solvents.

As also shown in FIG. 10, the LED diode body 1012 is secured to the interior surface of the lamp base 1004, rather than inner wall 1020 of the lamp holder 1006. The LED diode body 1012 can be held in the lamp base 1004 by an interference fit, as described herein, or by a bond 1022. Again, the bond may comprise an adhesive bond, a thermally formed bond, such as a sonic bond or other thermal bond, or a bond formed by a solvent. Plug 1014 illustrated in FIG. 10, may have an interference fit with the interior wall 1020 of the lamp holder 1006, or may be held in place by a bond 1028, in the manner described above. Wires 1016, 1018 are connected to LED pin leads 1024, 1026. Wires 1016, 1018 are inserted through the second opening of the lamp holder 1006 and may engage the plug 1014 in any of the ways described herein to form a seal in the second opening of the lamp housing 1006.

Figure 11:
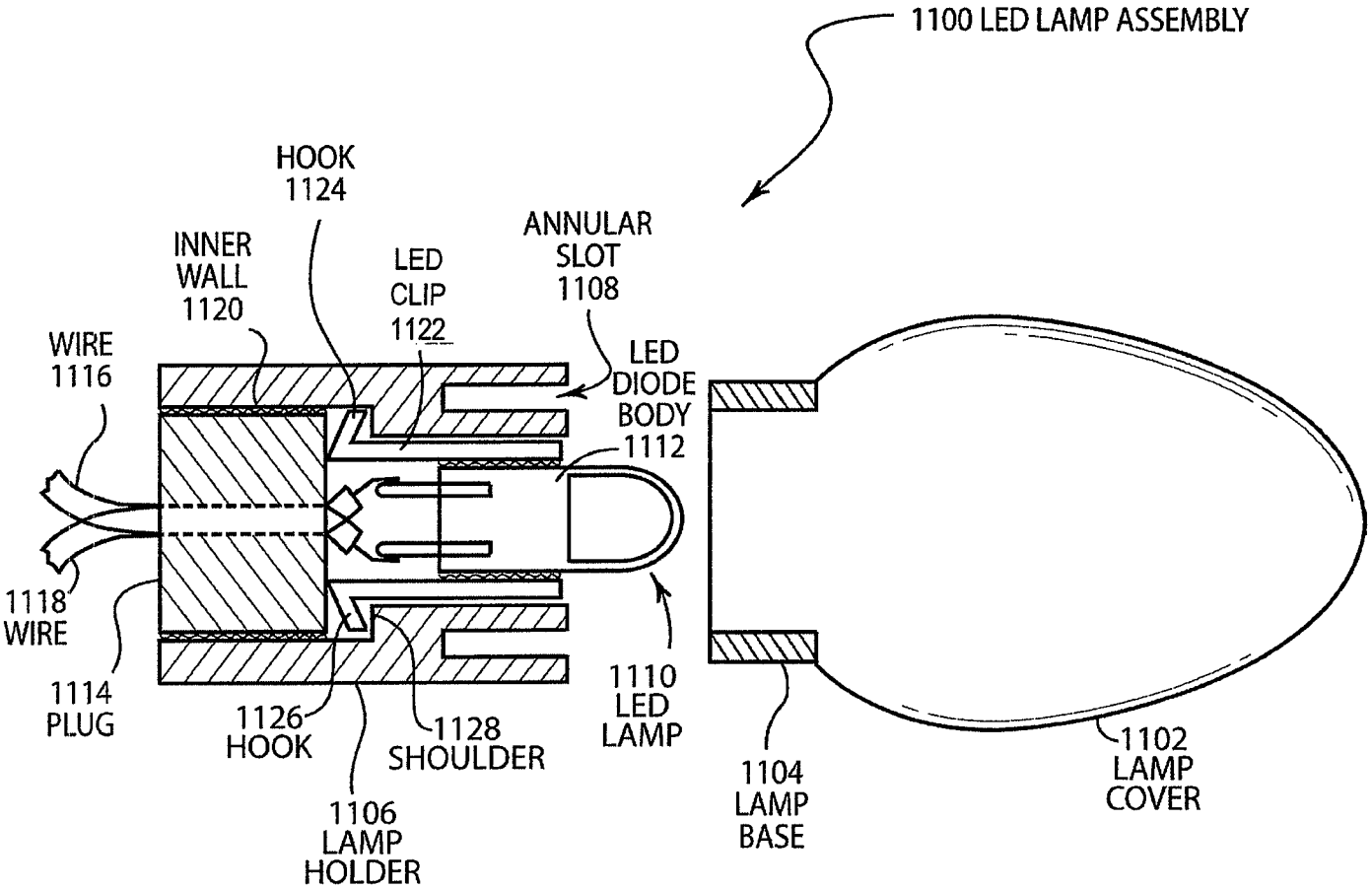
FIG. 11 is a schematic illustration of another embodiment of an LED lamp assembly.

FIG. 11 is a schematic illustration of another embodiment of an LED lamp assembly 1100. As shown in FIG. 11, lamp assembly 1100 includes a lamp cover 1102 that has a lamp base 1104. Lamp base 1104 is adapted to fit into the annular slot 1108 formed in the lamp holder 1106. Lamp base 1104 may create an interference fit with the annular slot 1108 or may be bonded to the annular slot 1108, as described with respect to the other embodiments disclosed herein. As also shown in FIG. 11, the LED diode body 1112 of the LED 1110 is attached to an LED clip 1122. The LED diode body 1112 can be attached to the LED clip 1122 with a bond or an interference fit. LED clip 1122 has hooks 1124, 1126 that engage the shoulder 1128 on the inner wall 1120 of the lamp holder 1106. The LED 1110, which is attached to the LED clip 1122, can be inserted through the second opening on the left side of the lamp holder 1106, as illustrated in FIG. 11, until hooks 1124, 1126 engage shoulder 1128. At that point, the LED 1110 extends outwardly from the first opening of lamp holder 1106 sufficiently to project light through the lamp cover 1102 when the lamp cover 1102 is attached to the lamp holder 1106. Plug 1114 is inserted in the second opening of the lamp holder 1106 until the plug 1114 abuts against the hooks 1124, 1126. When the plug 1114 is securely attached to the lamp holder 1106, the plug 1114 holds the hooks 1124, 1126 in place in the lamp holder 1106. In other words, the plug 1114 causes the hooks 1124 to abut against the shoulder 1128 to hold the LED lamp 1110 in the proper location in the LED lamp assembly 1100. Wires 1116, 1118 extend through the second opening in the lamp holder 1106 and can interface with the plug 114 in any of the ways disclosed herein.

Figure 12:
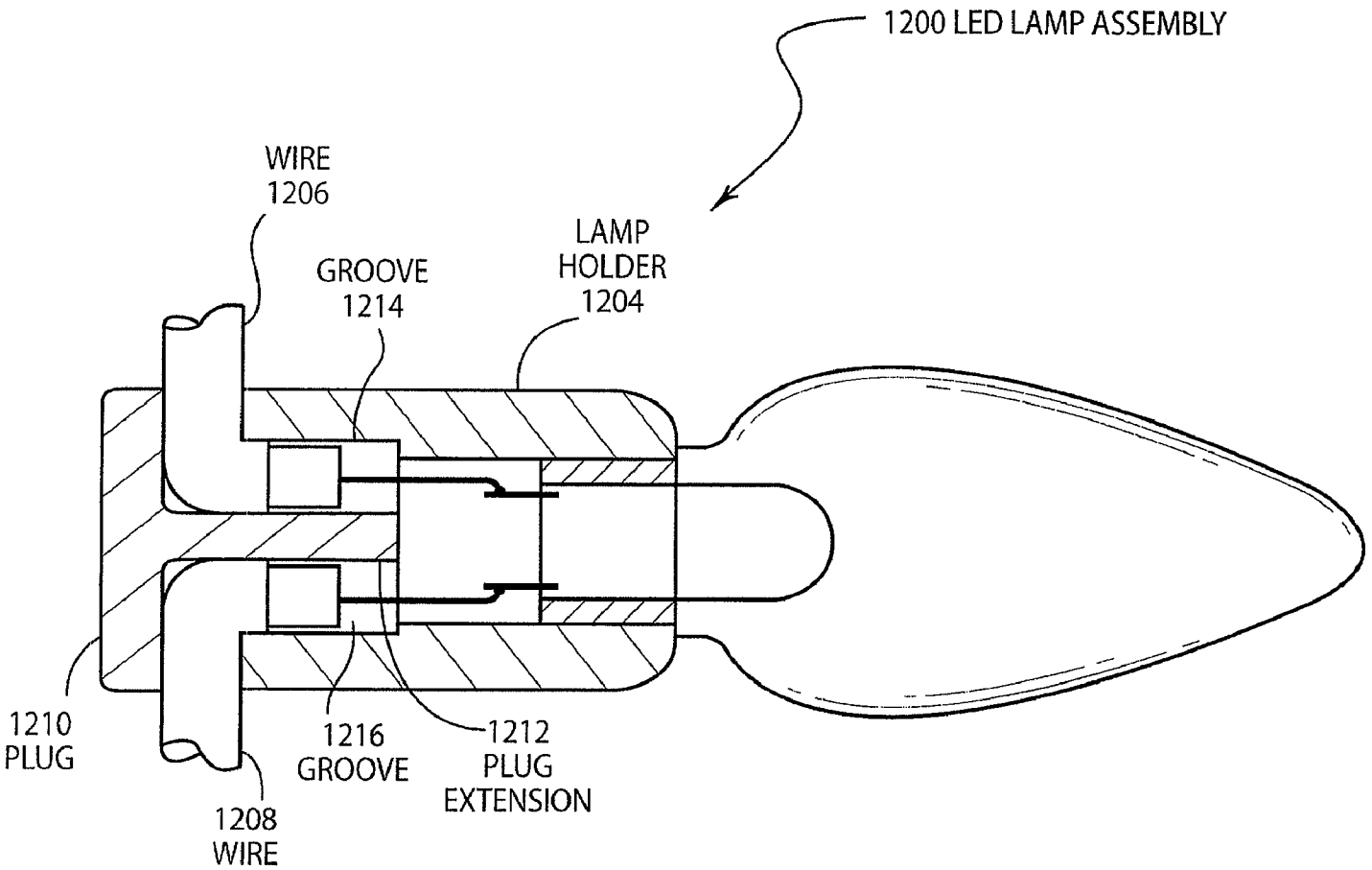
FIG. 12 is a schematic illustration of another embodiment of an LED lamp assembly.

FIG. 12 is a schematic illustration of another embodiment of an LED lamp assembly 1200. As shown in FIG. 12, plug 1210 has a unique configuration. Plug 1210 has a plug extension 1212 that extends between the wires 1206 and 1208 to prevent accidental contact of those wires. Plug 1210 has grooves 1214, 1216 that allow the wires 1206, 1208, respectively, to extend through the body of the plug 1210. Plug 1210 can be securely attached to lamp holder 1204 using an interference fit or a bond, as described herein.

Figure 13:
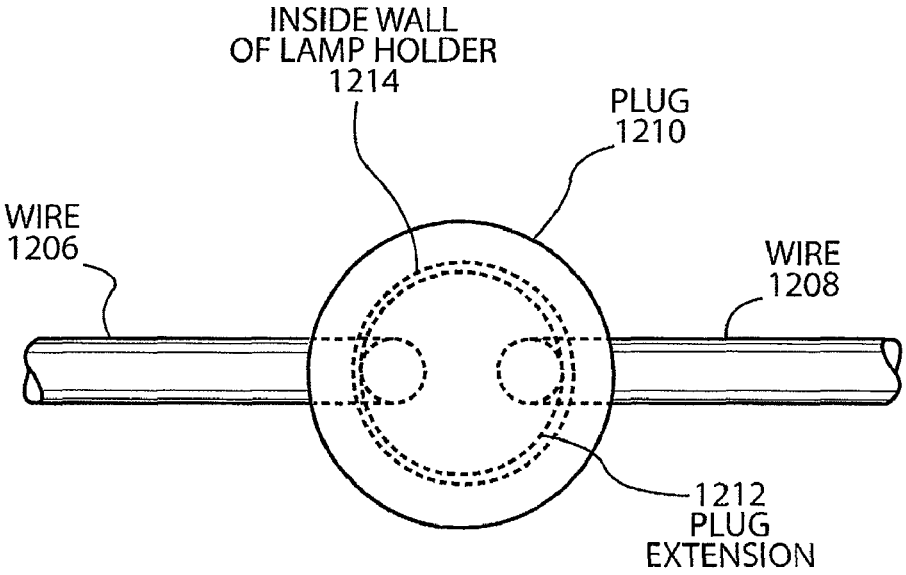
FIG. 13 is an end view of the plug illustrated in FIG. 12.

FIG. 13 is an end view of the plug 1210 illustrating the manner in which the wires 1206, 1208 extend through the plug 1210. The inside wall 1214 of the lamp holder is also illustrated in FIG. 13. The plug extension 1212, which constitutes the body of the plug 1210, may provide an interference fit with the inside wall 1214 of the lamp holder 1204, or may be bonded to the inside wall 1214 in the various ways described herein.

Figure 14:
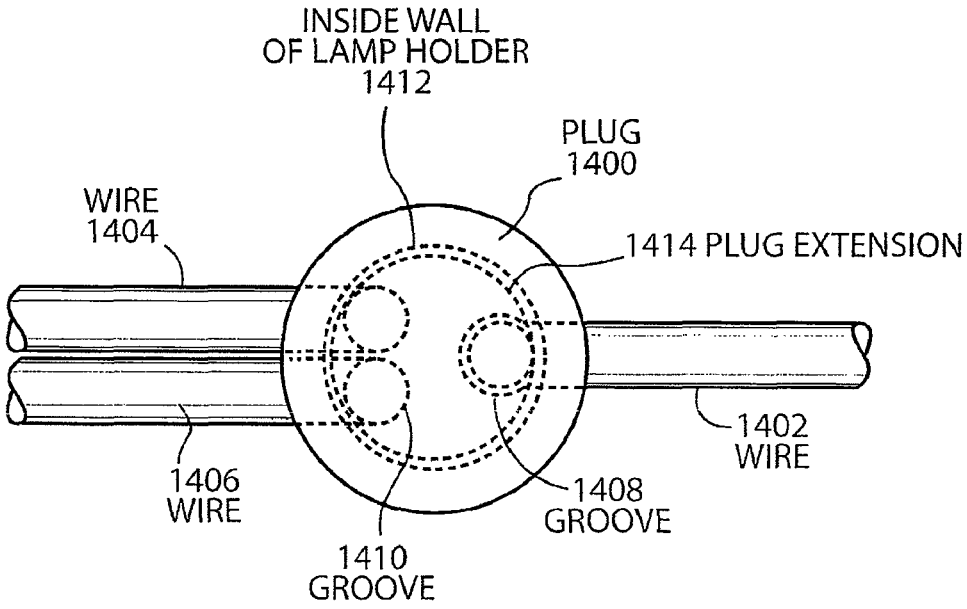
FIG. 14 is an end view of another embodiment of a plug.

FIG. 14 is an end view of another embodiment of a plug 1400. As shown in FIG. 14, plug 1400 is similar to plug 1210, with the exception that grooves 1408, 1410 are formed in the plug extension 1414 to accommodate three wires, i.e. wires 1402, 1404, 1406. The plug extension 1414 may have an interference fit with the inside wall 1412 of the lamp holder, or may be bonded to the inside wall 1412.

Figure 15:
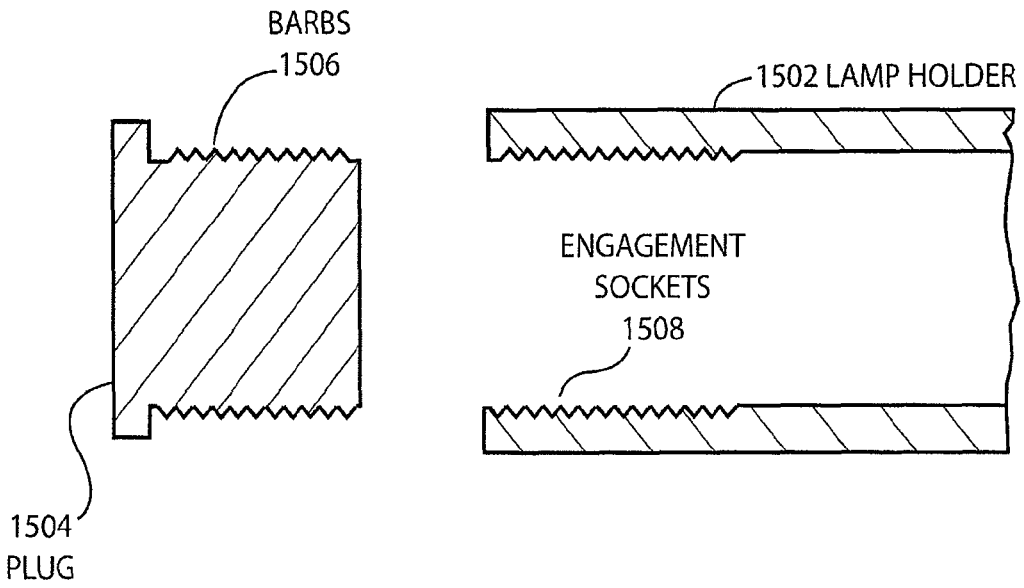
FIG. 15 is a schematic illustration of another embodiment of a plug and lamp holder.

FIG. 15 is a schematic illustration of another embodiment for securing the plug 1504 to the lamp holder 1502. As shown in FIG. 15, barbs 1506 are formed on the exterior surface of the plug 1504. Engagement sockets 1508 are formed on the interior wall of the lamp holder 1502. The barbs 1506 on plug 1504 engage the engagement sockets 1508 on lamp holder 1502 to ensure that once the plug 1504 is inserted into the lamp holder 1502, the plug 1504 will be substantially inseparably connected to the lamp holder 1502.

Figure 16:
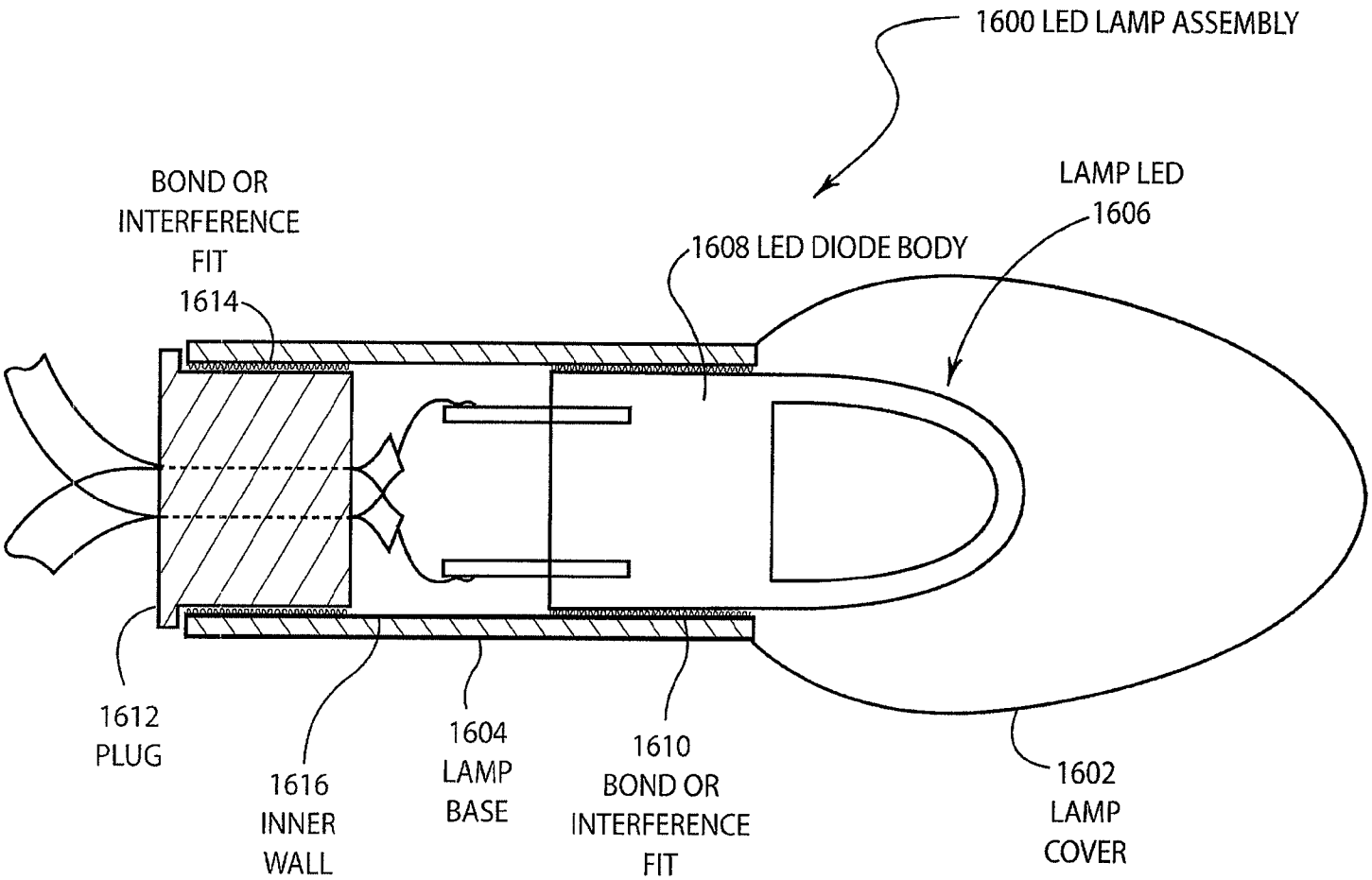
FIG. 16 is a schematic illustration of another embodiment of an LED lamp assembly.

FIG. 16 is a schematic illustration of another embodiment of an LED lamp assembly 1600. As shown in FIG. 16, lamp cover 1602 has an extended lamp base 1604. FIG. 16 does not include a lamp holder. As shown in FIG. 16, the LED lamp 1606 has an LED diode body 1608 that is attached to the interior wall 1616 of the lamp base 1604 using a bond or an interference fit, as described herein. Similarly, plug 1612 is attached to the inner wall 1616 of the lamp base 1604 using a bond or an interference fit 1614. The advantage of the device illustrated in FIG. 16 is that the LED lamp assembly 1600 is simple and uses fewer parts.

Hence, the various embodiments disclosed herein allow for the assembly of discrete components that are individually manufactured. The assembly process avoids damage to LED diodes and electric wires that can occur during overmolding in injection molding devices. The various embodiments illustrate a substantially inseparable LED lamp assembly that is formed on an LED light string that is resistant to theft and vandalism. The disclosed embodiments reduce manufacturing costs related to the high cost of special injection molding devices that are needed to accommodate LED lamps and LED lamp strings and eliminates the necessity for assembly at the site of the injection molder.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of assembling a substantially inseparable LED lamp assembly from individual discrete components comprising:

providing a lamp holder that is formed as an annulus with a first opening on a first end of said annulus and a second opening on a second end of said annulus;

substantially permanently securing a lamp cover to said first end of said annulus so that said lamp cover is substantially inseparable from said lamp holder and forms a watertight seal with said lamp holder;

providing an LED lamp having LED pin leads;

attaching wires directly to said LED pin leads of said LED lamp that have a predetermined size and a predetermined shape;

inserting said LED lamp through said second opening of said second end of said annulus to a position where said LED lamp is oriented to allow light from said LED lamp to be transmitted through said lamp cover;

substantially permanently attaching said LED lamp directly to said annulus so that said LED lamp is substantially inseparable from said annulus;

inserting a plug into said second opening of said second end of said annulus, said plug having indentations along an outer surface that substantially match said predetermined size and said predetermined shape of said wires so that said plug forms a watertight seal with said wires;

substantially permanently sealing said plug in said second opening to form a watertight seal at said second end of said annulus.

2. The method of claim 1 wherein said process of substantially permanently securing a lamp cover to said first end of said annulus comprises bonding said lamp cover to said annulus.

3. The method of claim 1 wherein said process of bonding said lamp cover to said annulus comprises bonding said lamp cover to an annular slot in said first end of said annulus.

4. The method of claim 3 wherein said process of bonding comprises adhesively bonding said lamp cover to said annular slot.

5. The method of claim 3 wherein said process of bonding comprises thermally bonding said lamp cover to said annular slot.

6. The method of claim 3 wherein said process of bonding comprises sonically bonding said lamp cover to said annular slot.

7. The method of claim 1 wherein said process of bonding said lamp cover to said annulus comprises bonding said lamp cover to an inside surface of said annulus.

8. The method of claim 7 wherein said process of substantially permanently attaching said LED lamp to said annulus comprises bonding said LED lamp to an inside surface of a lamp base of said lamp holder.

9. The method of claim 1 wherein said process of substantially permanently securing said lamp cover to said first end of said annulus comprises providing an interference fit between said lamp cover and said first opening.

10. The method of claim 9 wherein said process of substantially permanently securing said lamp cover to said first end of said annulus comprises inserting a lamp base having barbs into an annular slot having engagement sockets.

11. The method of claim 1 wherein said process of substantially permanently attaching said LED lamp to said annulus comprises bonding said LED lamp to an inside surface of said annulus.

12. The method of claim 1 wherein said process of substantially permanently attaching said LED lamp to said annulus comprises securing said LED lamp to said annulus with a clip.

13. The method of claim 1 wherein said process of substantially permanently attaching said LED lamp to said annulus comprises providing an interference fit between said LED lamp and said annulus.

14. The method of claim 1 wherein said process of sealing said plug in said second opening comprises providing an interference fit between said plug and said second opening.

15. The method of claim 14 wherein said process of substantially permanently attaching said LED lamp to said annulus with an interference fit comprises inserting said plug having barbs into said second end of said annulus that has barb sockets.

16. The method of claim 1 wherein said process of sealing said plug in said second opening comprises bonding said plug in said second opening of said annulus.

17. The method of claim 16 wherein said process of bonding said plug in said second opening of said annulus comprises adhesively attaching said plug in said second opening of said annulus.

18. An LED lamp assembly that is constructed of individual components that are separately fabricated and are assembled to provide a substantially inseparable LED lamp assembly comprising:

a lamp holder that is shaped as an annulus, said annulus having a first opening on a first end and a second opening on a second end;

a lamp cover substantially permanently attached to said first end of said annulus so that said lamp cover is substantially inseparable from said lamp holder and a watertight seal is formed between said lamp cover and said lamp holder;

an LED lamp inserted through said second opening of said annulus and substantially permanently attached in said annulus so that said LED lamp is substantially inseparable from said lamp holder and forms a watertight seal with said lamp holder in a position that orients said LED lamp to allow light to be transmitted through said lamp holder, said LED lamp having LED lead pins attached to said LED lamp;

wires that are conductively connected directly to said LED lead pins and extend through said second opening of said second end of said annulus, said wires having a predetermined size and shape;

a plug having indentations along an outer surface that substantially match said predetermined size and shape of said wires, said plug substantially permanently inserted in said second opening to prevent disassembly of said LED lamp assembly and to create a watertight seal between said plug and said second opening in said annulus.

19. The LED lamp assembly of claim 18 wherein said lamp cover comprises a lamp cover that is bonded to said first opening of said annulus.

20. The LED lamp assembly of claim 18 wherein said lamp cover provides an interference fit between said lamp cover and said first end of said annulus.

21. The LED lamp assembly of claim 20 wherein said interference fit is formed by barbs disposed on said lamp holder and barb sockets disposed in an annular slot in said annulus.

22. The LED lamp assembly of claim 18 wherein said LED lamp comprises an LED lamp that is substantially permanently attached to said lamp holder by bonding said LED lamp to said annulus.

23. The LED lamp assembly of claim 18 further comprising:

a clip that substantially permanently attaches said LED lamp to said lamp holder.

24. The LED lamp assembly of claim 18 wherein said LED lamp creates an interference fit between said LED lamp and said lamp holder.

25. The LED lamp assembly of claim 18 wherein a bond is formed between said plug and said second opening.

26. The LED lamp of claim 25 wherein said bond is formed from an adhesive.

27. The LED lamp of claim 26 wherein said bond is formed between said lamp cover and an annular slot formed in said first end of said annulus.

28. The LED lamp of claim 26 wherein said bond is formed between an exterior surface of a lamp base of said lamp cover and an interior surface of said annulus.

29. The LED lamp assembly of claim 28 wherein said plug creates an interference fit with said second opening of said annulus.

30. The LED lamp assembly of claim 29 wherein said plug has barbs that engage sockets on an interior surface of said lamp holder so that said plug is substantially permanently attached to said lamp holder.

31. The LED lamp assembly of claim 29 wherein said plug has a size that creates said interference fit with said second opening.

32. The LED lamp of claim 25 wherein said bond is a bond formed from a thermal weld between said lamp holder and said lamp cover.

33. The LED lamp of claim 25 wherein said bond is a bond formed from a sonic weld between said lamp holder and said lamp cover.

34. The LED lamp of claim 25 wherein said bond is a bond that is formed from a weld between said lamp holder and said lamp cover that is created by a solvent.

35. The LED lamp assembly of claim 18 wherein a bond is created between said plug and said second opening.

36. The LED lamp assembly of claim 35 wherein said bond comprises an adhesive bond.

37. The LED lamp assembly of claim 35 wherein said bond comprises a thermal bond.

38. The LED lamp assembly of claim 35 wherein said bond comprises a bond formed by sonic waves.

39. The LED lamp assembly of claim 35 wherein said bond comprises a bond formed by solvents.

* * * * *